US010774845B2

(12) United States Patent
Mercer et al.

(10) Patent No.: US 10,774,845 B2
(45) Date of Patent: Sep. 15, 2020

(54) ACOUSTIC TREATMENT FOR AN INDOOR HVAC COMPONENT

(71) Applicant: Carrier Corporation, Farmington, CT (US)

(72) Inventors: Kevin Mercer, Danville, IN (US); Asad M. Sardar, Avon, IN (US); Barry W. Lee, Greenwood, IN (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 939 days.

(21) Appl. No.: 14/710,158

(22) Filed: May 12, 2015

(65) Prior Publication Data

US 2015/0345514 A1 Dec. 3, 2015

Related U.S. Application Data

(60) Provisional application No. 62/006,589, filed on Jun. 2, 2014.

(51) Int. Cl.

| | |
|---|---|
| ***F04D 29/66*** | (2006.01) |
| ***F04D 19/00*** | (2006.01) |
| ***F04D 25/08*** | (2006.01) |
| ***G10K 11/16*** | (2006.01) |
| *G10K 11/162* | (2006.01) |

(52) U.S. Cl.

CPC ..... *F04D 29/664* (2013.01); *F04D 19/002* (2013.01); *F04D 25/08* (2013.01); *G10K 11/161* (2013.01); *G10K 11/162* (2013.01)

(58) Field of Classification Search

CPC .... F04D 25/08; F04D 29/664; F05D 2260/96; G10K 11/161

See application file for complete search history.

(56) References Cited

U.S. PATENT DOCUMENTS

| | | | | |
|---|---|---|---|---|
| 542,626 A | | 7/1895 | Ferro Cardozo | |
| 635,859 A | | 10/1899 | King | |
| 640,261 A | | 1/1900 | Beeman | |
| 641,957 A | | 1/1900 | Heidel | |
| 708,685 A | | 9/1902 | White | |
| 746,768 A | | 12/1903 | West | |
| 829,405 A | | 8/1906 | Knott | |
| 1,899,403 A | * | 2/1933 | Venzie | E04B 9/001 52/145 |
| 2,112,631 A | * | 3/1938 | MacDonald | E04B 9/001 52/144 |
| 2,172,771 A | * | 9/1939 | Forbush | F24D 3/12 454/296 |
| 2,180,945 A | * | 11/1939 | Morey | E04B 9/02 181/224 |

(Continued)

FOREIGN PATENT DOCUMENTS

| | | |
|---|---|---|
| CA | 2830732 C | 10/2012 |
| CN | 101189415 B | 6/2012 |

(Continued)

*Primary Examiner* — Ninh H. Nguyen

(74) *Attorney, Agent, or Firm* — Cantor Colburn LLP

(57) ABSTRACT

An acoustic treatment for an indoor HVAC component is provided having an inner liner and at least one aperture formed through the inner liner. An acoustic absorber is positioned adjacent the inner liner. A gap, including a width dimension, is formed between the inner liner and the acoustic absorber.

15 Claims, 2 Drawing Sheets

(56) References Cited

U.S. PATENT DOCUMENTS

| | | | | | |
|---|---|---|---|---|---|
| 2,221,001 | A * | 11/1940 | Lucius | E04B 9/02 165/57 |
| 3,537,544 | A * | 11/1970 | King | F04D 29/664 181/225 |
| 3,949,830 | A | 4/1976 | Muehlbauer et al. | |
| 4,432,434 | A | 2/1984 | Dean, Jr. | |
| 5,259,157 | A * | 11/1993 | Ault | E01F 8/007 52/145 |
| 5,426,268 | A | 6/1995 | Yazici et al. | |
| 5,983,888 | A | 11/1999 | Anselmino | |
| 6,358,590 | B1 | 3/2002 | Blair et al. | |
| 6,402,612 | B2 | 6/2002 | Akhtar et al. | |
| 6,419,576 | B1 | 7/2002 | Han | |
| 7,086,857 | B2 | 8/2006 | Lai et al. | |
| 7,467,687 | B2 | 12/2008 | Mitchell et al. | |
| 8,294,059 | B2 | 10/2012 | Calder et al. | |
| 8,770,340 | B2 * | 7/2014 | Cursetjee | F24F 13/24 181/224 |
| 9,091,280 | B2 * | 7/2015 | Hopkins | F04D 29/665 |
| 2007/0181204 | A1 | 8/2007 | Stout | |
| 2013/0118830 | A1 | 5/2013 | Cursetjee | |
| 2013/0264147 | A1 | 10/2013 | Sugimoto et al. | |

FOREIGN PATENT DOCUMENTS

| | | | |
|---|---|---|---|
| EP | 1798492 | A2 | 6/2007 |
| EP | 2436866 | A2 | 4/2012 |
| GB | 2033075 | B | 4/1983 |
| WO | 2008005728 | A1 | 1/2008 |

* cited by examiner

ACOUSTIC TREATMENT FOR AN INDOOR HVAC COMPONENT

CROSS REFERENCE TO RELATED APPLICATIONS

The present application is related to, and claims the priority benefit of, U.S. Provisional Patent Application Ser. No. 62/006,589 filed Jun. 2, 2014, the contents of which are hereby incorporated in their entirety into the present disclosure.

TECHNICAL FIELD OF THE DISCLOSED EMBODIMENTS

The presently disclosed embodiments generally relate to heating, ventilation, and air-conditioning (HVAC) systems, and more particularly, to an acoustic treatment for use with an HVAC system.

BACKGROUND OF THE DISCLOSED EMBODIMENTS

Fan coil units are now being constructed with axial fan technology rather than a forward curved blower system. Axial fan systems require a mounting deck with a means to slide the deck into the fan coil unit for support. A sheet metal inner liner provides the mounting structure for the axial fan. However, if this inner liner is composed entirely of sheet metal, there is potential that the sound and vibration from the fan system is not absorbed or dampened. Thus, there is a need to devise an "inner liner" that is more conducive to mitigation of sound from the fan coil unit.

Typically, forward curved blower systems are used within residential air handlers and furnaces. Over time, axial fan technology has been introduced to residential air handlers. Typically, axial fan system require a mounting deck that slidably engages with a support within the air handler. Typically, an inner liner provides the mounting structure for the axial fan system. When the inner liner is composed of sheet metal, sound and vibration produced by the axial fan system provide undesirable results. There is therefore a need to reduce the sound and vibration within the HVAC component using an axial fan system.

SUMMARY OF THE DISCLOSED EMBODIMENTS

In at least one embodiment, an acoustic treatment for an indoor HVAC component is provided having an inner liner and at least one aperture formed through the inner liner. An acoustic absorber is positioned adjacent the inner liner. A gap, including a width dimension, is formed between the inner liner and the acoustic absorber.

In at least one embodiment, an indoor HVAC component is provided having an enclosure including at least one wall, and a fan assembly disposed within the enclosure. An acoustic treatment is coupled to the at least one wall and positioned proximate to the fan assembly. The acoustic treatment includes an inner liner and at least one aperture formed through the inner liner. An acoustic absorber is positioned adjacent the inner liner. A gap, including a width dimension, is formed between the inner liner and the acoustic absorber.

In at least one embodiment, an HVAC system is provided including at least one indoor HVAC component having an enclosure including at least one wall, and a fan assembly disposed within the enclosure. An acoustic treatment is coupled to the at least one wall and positioned proximate to the fan assembly. The acoustic treatment includes an inner liner and at least one aperture formed through the inner liner. An acoustic absorber is positioned adjacent the inner liner. A gap, including a width dimension, is formed between the inner liner and the acoustic absorber.

BRIEF DESCRIPTION OF THE DRAWINGS

The embodiments and other features, advantages and disclosures contained herein, and the manner of attaining them, will become apparent and the present disclosure will be better understood by reference to the following description of various exemplary embodiments of the present disclosure taken in conjunction with the accompanying drawings, wherein.

DETAILED DESCRIPTION OF THE DISCLOSED EMBODIMENTS

Figure 1:
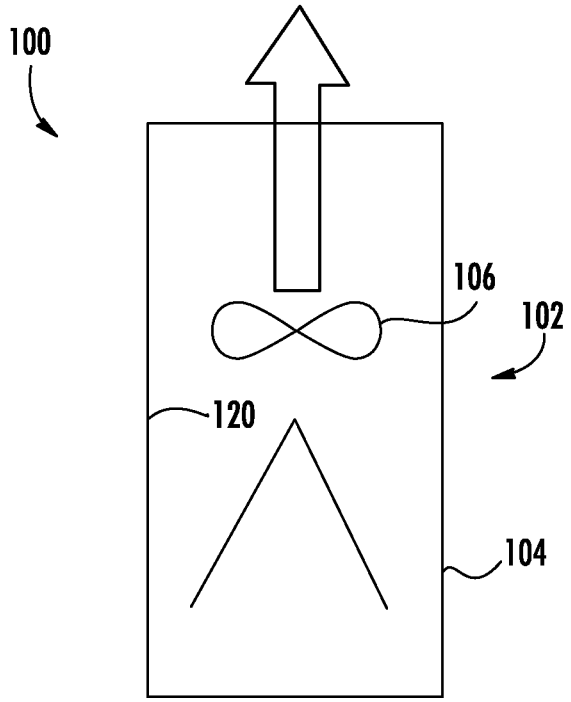
FIG. 1 is a schematic cross-sectional view of an indoor HVAC component formed in accordance with an embodiment.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

FIG. 1 illustrates an indoor HVAC component 100 having an enclosure 102 formed by at least one wall 104. An axial fan 106 is positioned within the enclosure 102. The axial fan 106 includes a motor and fan blades extending radially from the motor. In one embodiment, a stator may be positioned adjacent to the fan blades.

At least one acoustic treatment 120 is positioned along the at least one wall 104. The acoustic treatment 120 is positioned proximate to the axial fan 106 and is configured to absorb noise from the axial fan 106. In particular, the acoustic treatment 120 is configured such that the acoustic treatment 120 absorbs frequencies which are common to axial fans 106. Such frequencies are typically not generated by other configurations of fans. Accordingly, the configuration of the acoustic treatment 120 is customized for axial fans 106.

While the disclosed embodiments are discussed with respect to an indoor HVAC component 100, it should be noted that the acoustic treatment 120 described herein may be utilized with other appliances having an axial fan, such as refrigerators or the like. Additionally, in at least one embodiment, the acoustic treatment described herein may be utilized with an appliance that does not include an axial fan.

Figure 2:
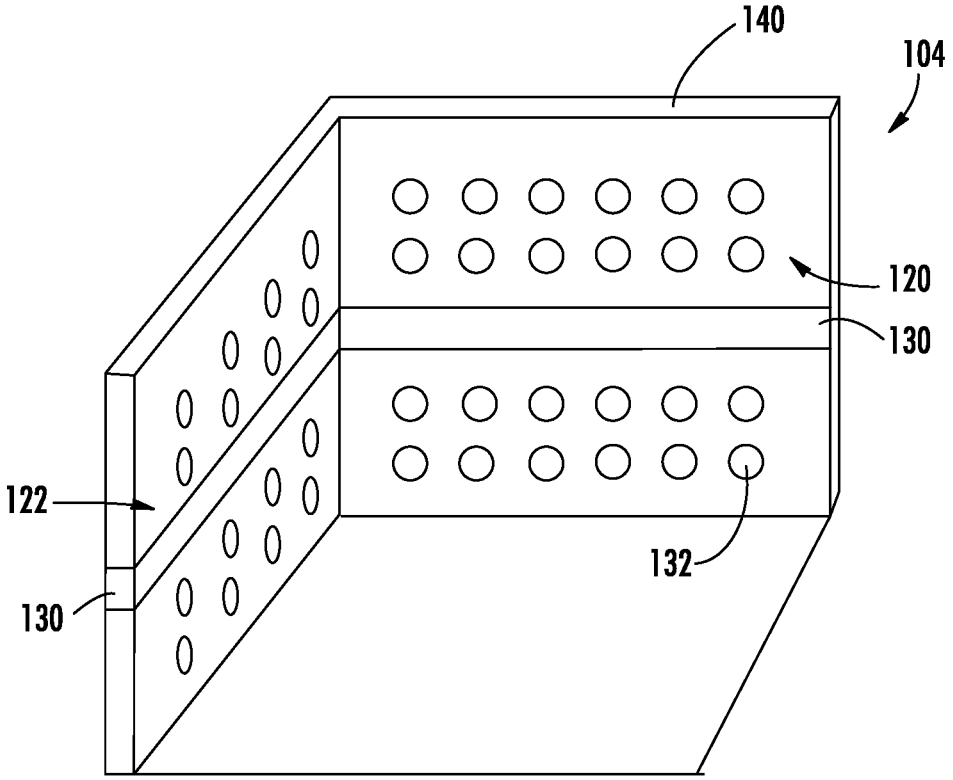
FIG. 2 is a schematic front view of an acoustic treatment for an indoor HVAC component.

FIG. 2 illustrates a front view of the acoustic treatment 120. The acoustic treatment 120 includes an inner liner 122. In at least one embodiment, the inner liner 122 is formed from metal, for example sheet metal. However, it should be appreciated that other materials may be used for the inner liner 122, such as plastics and composites. The inner liner 122 is positioned adjacent the at least one wall 104 and is configured to face the enclosure 102 of the indoor HVAC component 100 so that the inner liner 122 is positioned proximate to the axial fan 106.

In at least one embodiment, the inner liner 122 is not contiguous. Rather, the inner liner 122 includes a rail 130 formed therethrough. The rail 130 is configured to receive components of the indoor HVAC component 100. For example, the axial fan 106 may be slid into the indoor HVAC component 100 on the rail 130 and mounted thereto. Additionally, components such as an electrical heater may be secured to the rail 130 for use within the indoor HVAC component 100.

The inner liner 122 includes at least one aperture 132 extending therethrough. The at least one aperture 132 is configured to allow sound waves to pass through the inner liner 122. In the illustrated embodiment, the apertures 132 are circular. In at least one embodiment, the apertures 132 may have any shape or size that optimizes the absorption of sound waves within the indoor HVAC component 100. For example, the apertures 132 may be triangular, square, pentagonal, hexagonal, and/or any other suitable shape and size. Additionally, the apertures 132 are illustrated as being arranged in rows. In at least one embodiment, the apertures 132 may be formed in any arrangement that is configured to absorb sound. For example, the apertures 132 may be arranged in circles and/or any other suitable configuration.

Figure 3:
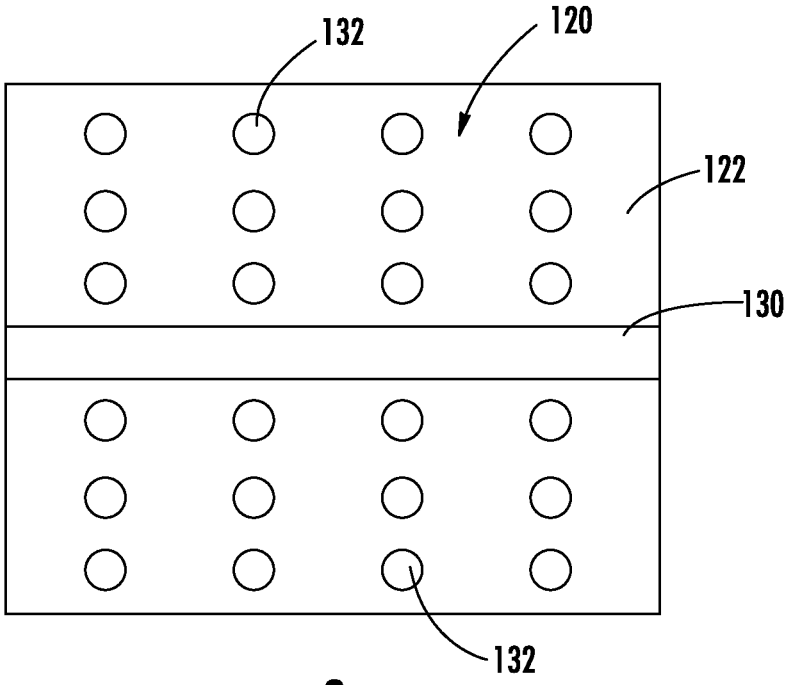
FIG. 3 is a schematic cross-sectional side view of an acoustic treatment for an indoor HVAC component.
Figure 4:
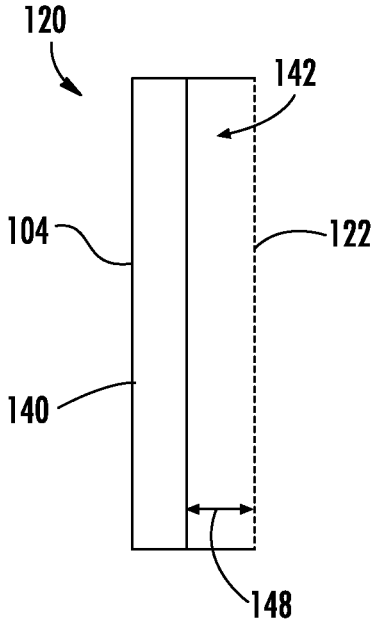
FIG. 4 is a schematic side view of an acoustic treatment for an indoor HVAC component.

As illustrated in FIGS. 3 and 4, the acoustic treatment 120 further includes an acoustic absorber 140 that is positioned between the inner liner 122 and the wall 104 of the indoor HVAC component 100. The acoustic absorber 140 may be formed from any material capable of absorbing sound waves. In at least one embodiment, the sound absorber 140 is formed from foam and/or fiberglass. Sound waves passing though the apertures 132 in the inner liner 120 are absorbed by the acoustic absorber 140.

A gap 142 is formed between the inner liner 122 and the acoustic absorber 140. The gap 142 attenuates the sound waves as they pass from the apertures 132 in the inner liner 122 to the acoustic absorber 140. The gap 142 has a width defined from the inner liner 122 to the acoustic absorber 140 that increases sound attenuation as the sound waves pass through the gap 142. In one embodiment, the width of the gap 142 is less than approximately 15 millimeters. In one embodiment, the width 148 of the gap 142 is between approximately 4 and approximately 12 millimeters. In one embodiment, the width 148 of the gap 142 is between approximately 4 and approximately 6 millimeters. In one embodiment, the width 148 of the gap is approximately 6 millimeters.

It will therefore be appreciated that the disclosed embodiments provide an acoustic treatment that is tailored to an indoor HVAC component including an axial fan. Because axial fans operate at different frequencies than other fans, such an acoustic treatment has not been necessary in the past for air handlers that did not include an axial fan. The combination of the inner liner, the acoustic absorber, and the gap provides increased sound attenuation within the indoor HVAC component.

While the invention has been illustrated and described in detail in the drawings and foregoing description, the same is to be considered as illustrative and not restrictive in character, it being understood that only certain embodiments have been shown and described and that all changes and modifications that come within the spirit of the invention are desired to be protected.

What is claimed is:

1. An acoustic treatment for an indoor HVAC enclosure comprising:

an inner liner;

at least one aperture formed through the inner liner;

an acoustic absorber positioned adjacent the inner liner;

a gap, including a width dimension, formed between the inner liner and the acoustic absorber; and a rail extending through the inner liner, the rail configured to mount an HVAC component.

2. The acoustic treatment of claim 1, wherein the width dimension is less than or equal to approximately 15 millimeters.

3. The acoustic treatment of claim 1, wherein the inner liner comprises a metal.

4. The acoustic treatment of claim 1, wherein the acoustic absorber comprises at least one of foam and fiberglass.

5. The acoustic treatment of claim 1, wherein the at least one aperture further comprises a plurality of apertures formed in a pattern.

6. The acoustic treatment of claim 1, wherein the at least one aperture is shaped as at least one of a circle, a triangle, a square, a pentagon, or a hexagon.

7. An indoor HVAC assembly comprising:

an enclosure including at least one wall;

a fan assembly disposed within the enclosure; and an acoustic treatment coupled to the at least one wall and positioned proximate to the fan assembly, wherein the acoustic treatment comprises:

an inner liner, at least one aperture formed through the inner liner, an acoustic absorber positioned adjacent the inner liner, and a rail extending through the inner liner, the rail configured to mount an HVAC component, and a gap, including a width dimension, formed between the inner liner and the acoustic absorber.

8. The indoor HVAC assembly of claim 7, wherein the width dimension is less than or equal to approximately 15 millimeters.

9. The indoor HVAC assembly of claim 7, wherein the inner liner comprises a metal.

10. The indoor HVAC assembly of claim 7, wherein the acoustic absorber comprises at least one of foam and fiberglass.

11. The indoor HVAC assembly of claim 7, wherein the at least one aperture further comprises a plurality of apertures formed in a pattern.

12. The indoor HVAC assembly of claim 7, wherein the at least one aperture is shaped as at least one of a circle, a triangle, a square, a pentagon, or a hexagon.

13. An HVAC system comprising:

an enclosure including at least one wall;

a fan assembly disposed within the enclosure; and an acoustic treatment coupled to the at least one wall and positioned proximate to the fan assembly, wherein the acoustic treatment comprises:

an inner liner, at least one aperture formed through the inner liner, an acoustic absorber positioned adjacent the inner liner, and a rail extending through the inner liner, the rail configured to mount an HVAC component, and a gap, including a width dimension, formed between the inner liner and the acoustic absorber.

14. The HVAC system of claim 13, wherein the width dimension is less than or equal to approximately 15 millimeters.

15. The HVAC system of claim 13, wherein the at least one aperture further comprises a plurality of apertures formed in a pattern, and the at least one aperture is shaped as at least one of a circle, a triangle, a square, a pentagon, or a hexagon.

* * * * *